US009431716B2

(12) United States Patent
Asplund et al.

(10) Patent No.: US 9,431,716 B2
(45) Date of Patent: Aug. 30, 2016

(54) LEAKY COAXIAL CABLE HAVING RADIATION SLOTS THAT CAN BE ACTIVATED OR DEACTIVATED

(75) Inventors: Henrik Asplund, Stockholm (SE); Jan-Erik Berg, Sollentuna (SE); Jonas Medbo, Uppsala (SE)

(73) Assignee: TELEFONAKTIEBOLAGET LM ERICSSON (publ), Stockholm (SE)

( * ) Notice: Subject to any disclaimer, the term of this patent is extended or adjusted under 35 U.S.C. 154(b) by 0 days.

(21) Appl. No.: 14/389,735

(22) PCT Filed: Apr. 2, 2012

(86) PCT No.: PCT/EP2012/055965

§ 371 (c)(1),
(2), (4) Date: Sep. 30, 2014

(87) PCT Pub. No.: WO2013/149643

PCT Pub. Date: Oct. 10, 2013

(65) Prior Publication Data

US 2015/0091673 A1 Apr. 2, 2015

(51) Int. Cl.

| | |
|---|---|
| ***H01Q 13/20*** | (2006.01) |
| ***H01Q 1/00*** | (2006.01) |
| ***H01P 3/06*** | (2006.01) |

(52) U.S. Cl.

CPC ..... *H01Q 13/203* (2013.01); *H01P 3/06* (2013.01); *H01Q 1/007* (2013.01)

(58) Field of Classification Search

CPC ..... H01Q 13/203; H01Q 13/20

USPC ..... 333/237

See application file for complete search history.

(56) References Cited

U.S. PATENT DOCUMENTS 3,593,143 A * 7/1971 Nakahara ..... H04B 5/0018 343/768

2013/0093638 A1* 4/2013 Shoemaker ..... H01Q 1/007 343/770

FOREIGN PATENT DOCUMENTS

WO 2011/162917 A2 12/2011

OTHER PUBLICATIONS

PCT International Search Report, mailed Dec. 4, 2012, in connection with International Application No. PCT/EP2012/055965, all pages.

PCT Written Opinion, mailed Dec. 4, 2012, in connection with International Application No. PCT/EP2012/055965, all pages.

English translation of Chinese Office Action issued Oct. 23, 2015 in connection with Chinese Application No. 201280071992.6, 2 pages.

English translation of claims of Chinese Office Action issued Oct. 23, 2015 in connection with Chinese Application No. 201280071992.6, 5 pages.

* cited by examiner

*Primary Examiner* — Benny Lee

(74) *Attorney, Agent, or Firm* — Leffler Intellectual Property Law, PLLC

(57) ABSTRACT

A leaky co-axial cable arrangement, including a co-axial cable, a plurality of radiation slots arranged on the co-axial cable and an activation arrangement configured for affecting predetermined regions on the cable to selectively activate or deactivate at least one of the plurality of radiation slots to provide the leaky co-axial cable arrangement.

12 Claims, 7 Drawing Sheets

LEAKY COAXIAL CABLE HAVING RADIATION SLOTS THAT CAN BE ACTIVATED OR DEACTIVATED

TECHNICAL FIELD

The present invention relates to leaky feeders in general, and specifically to an adaptable leaky feeder and the provisions of such a feeder.

BACKGROUND

Leaky cables (e.g. radiating cables, leaky feeders) are used in wireless cellular systems to provide improved coverage, especially in the case of tunnels or along railways but also in indoor deployments. The leaky cable acts as a very long antenna, which can help in obtaining a more uniform coverage level, compared to a single (small) antenna from which the radiated power falls off rapidly with distance. FIG. 1 depicts a comparison of the coverage of a leaky cable (on the left) and a point source antenna (on the right). The system has a limited range and because of the high frequency it uses, signal transmissions cannot pass through solid rock, which usually limits the system to line of sight applications.

A leaky feeder is typically designed as a coaxial cable (waveguide) where the outer conductor is perforated in order to create holes or slots through which some of the energy in the cable can escape and radiate into free space. Various designs exist for the slot geometry and separations, slots can be uniformly distributed along the length of the cable, or clustered in groups, thereby providing different radiating properties. Variations of the slot structure, shape, and density along the cable allow a cable designer to shape how much the cable is radiating from different sections and in what directions. The latter property is realized through selecting on which side of the cable the slots are placed, as each slot will have more or less pronounced directional radiation properties that essentially form a lobe or beam away from the cable. An example of a commercial leaky feeder (coaxial cable with radiating slots) is shown in FIG. 2. It has been found through measurements and numerical simulations that a leaky feeder such as the one depicted in FIG. 2 will have its radial radiation maximum in the direction that the slots are facing.

While the cable designer has plenty of freedom when designing the cable, it is next to impossible to provide a design that is optimal for a given installation since it is unknown beforehand where the cable will be installed. For instance, there might be sections along the cables length where it is undesirable that it radiates, such as where it passes through walls, floors, or cable ducts. Similarly, the orientation of the cable with respect to nearby structures such as walls, supports, and other cabling might be impossible to predict. Even if the preferred orientation is known, it might be difficult to achieve due to the cable rigidity and installation paths with curves and corners. Nearby metallic objects might partially cover the slots causing less radiation to escape from the cable, or lossy materials such as concrete walls may heavily attenuate the radiation.

The first problem is exemplified in FIG. 3 where a leaky feeder (leaky cable) is utilized to illuminate three separate areas or rooms, as indicated by the white squares. These areas could e.g. represent different rooms or floors in a building, or different tunnel sections. The surrounding area (between the rooms) represents parts of the installation area where radiation is undesirable, such as concrete walls or cable ducts where any radiation will be heavily attenuated and therefore not usable for communication. A cable that is radiating in these areas will therefore radiate less energy in the coverage areas. The dotted radiation lobes in FIG. 3 indicate this.

The second problem is exemplified in FIG. 4. A leaky feeder cable (leaky cable) is typically mounted on e.g. a wall as depicted in the figure. Inappropriate orientation of the cable close to a conductive object, as depicted by the black square in the upper part of the figure, may lead to lower radiation efficiency, since the slots are essentially covered by the conductive object. Similarly, inappropriate orientation close to a lossy object, as illustrated by the wall in the lower part of the figure, may lead to more attenuation of the radiated power. In both cases, less energy is radiated in the direction of the intended coverage area (as indicated by the arrow) compared to an optimal orientation of the cable.

Based on the above discussion, there is a need to provide a leaky feeder cable that supports a more optimal coverage and reduces the occurrence of the leaky cable radiating in undesirable directions or locations along its installed path.

SUMMARY OF THE INVENTION

The present disclosure aims to obviate some of the above-mentioned problems, and to provide methods and arrangements.

In a first aspect, the present disclosure includes a leaky co-axial cable arrangement, which includes a co-axial cable with a plurality of radiation slots. Further, the arrangement includes an activation arrangement configured for affecting predetermined regions on the co-axial cable to selectively activate or deactivate at least one of the plurality of radiation slots to provide the leaky co-axial cable arrangement.

In a second aspect, the present disclosure presents a method of providing a leaky co-axial cable arrangement by selectively activating or deactivating at least one of a plurality of radiation slots arranged on a co-axial cable.

One of the advantages of the present disclosure is a leaky cable arrangement that is easily adaptable to the premises in which it is installed, thereby making it less sensitive to the actual installation.

BRIEF DESCRIPTION OF THE DRAWINGS

The invention, together with further objects and advantages thereof, may best be understood by referring to the following description taken together with the accompanying drawings, in which.

DETAILED DESCRIPTION OF THE INVENTION

Throughout the drawings, the same reference numbers are used for similar or corresponding elements in different drawing figures. Accordingly, reference numbers need not be repeatedly defined and described in each instance.

An aim of the present disclosure is to improve the radiation efficiency and characteristics of a leaky cable by ensuring that the slots of the cable, when installed in the area of service, are optimally aligned with the desired coverage area. This is enabled by a novel cable design in which the radiating slots can be created or activated as well as deactivated after manufacturing and potentially after installation of the cable.

The basic idea of the present disclosure is a novel leaky cable design that contains a large number of radiating slots, active or inactive. After installation, for example in a building, radiating slots may be activated or deactivated in desired locations along the cable with simple operations such as described in the embodiments. The cable can therefore be installed with less consideration to radio coverage requirements; instead, the cable is adapted to the desired radio coverage by activating those radiating slots that are most beneficial for coverage and/or deactivating radiating slots that do not contribute to the radiating efficiency of the leaky cable. Similarly, the slots are not activated in areas where coverage is undesirable.

Although the disclosure is described in the context of a cable with one or more inactive slots, it is evident that the disclosure is equally applicable to a case where the cable includes a mix of inactive and active slots, or a cable with only active slots.

A typical leaky cable is designed with a uniform slot size and slot density along the length of the cable, causing a constant fraction of the power carried in the cable to be radiated from each slot. The radiation is usually characterized by the coupling loss, which determines the ratio between the power available inside the cable and the power received by a dipole antenna at a predetermined distance of 2 meters from the cable. Due to the radiation loss from the cable and conductivity losses inside the cable the power will experience attenuation along the length of the cable. The ratio between the radiation loss and the conductivity loss determines the radiation efficiency of the cable. While there exists cables with non-uniform slot densities and designs in order to equalize the radiated power along the cable length, such designs do not prevent the loss of efficiency due to power radiated in the wrong directions or along lengths of the cable that pass through ducts or walls.

Figure 1:
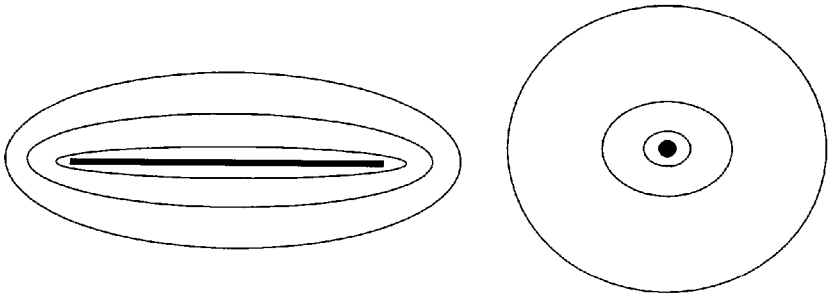
FIG. 1 is comparison of the coverage of a leaky cable and a point source antenna.
Figure 2:
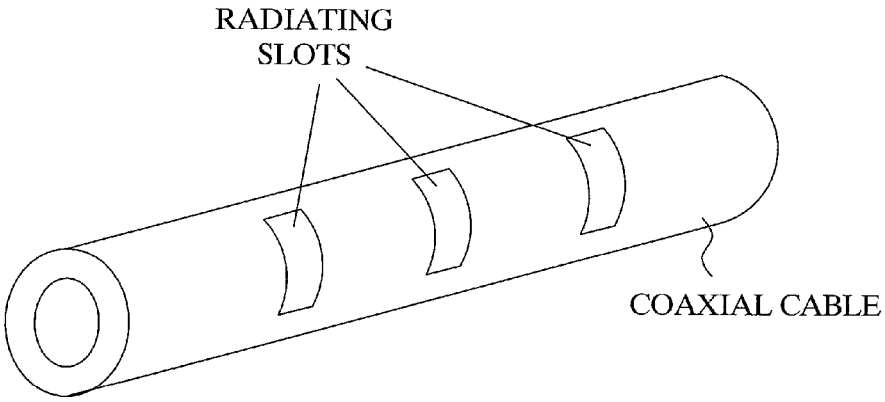
Fig. 2 (Prior Art)
FIG. 2 is an example of a prior art leaky cable.
Figure 3:
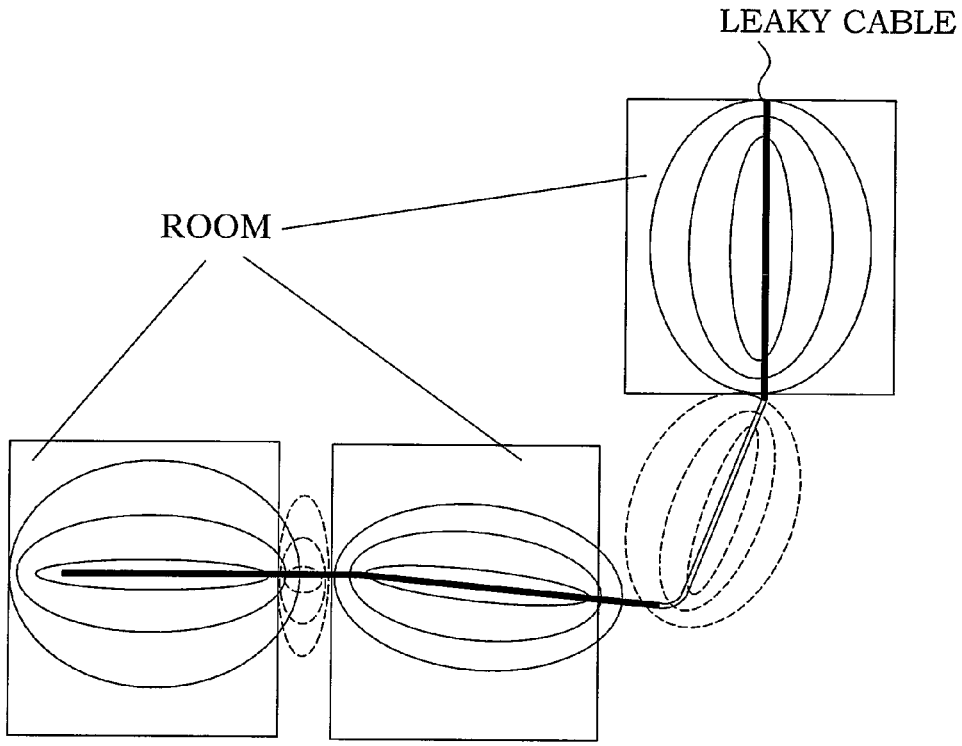
FIG. 3 is an example of a leaky cable installation.
Figure 4:
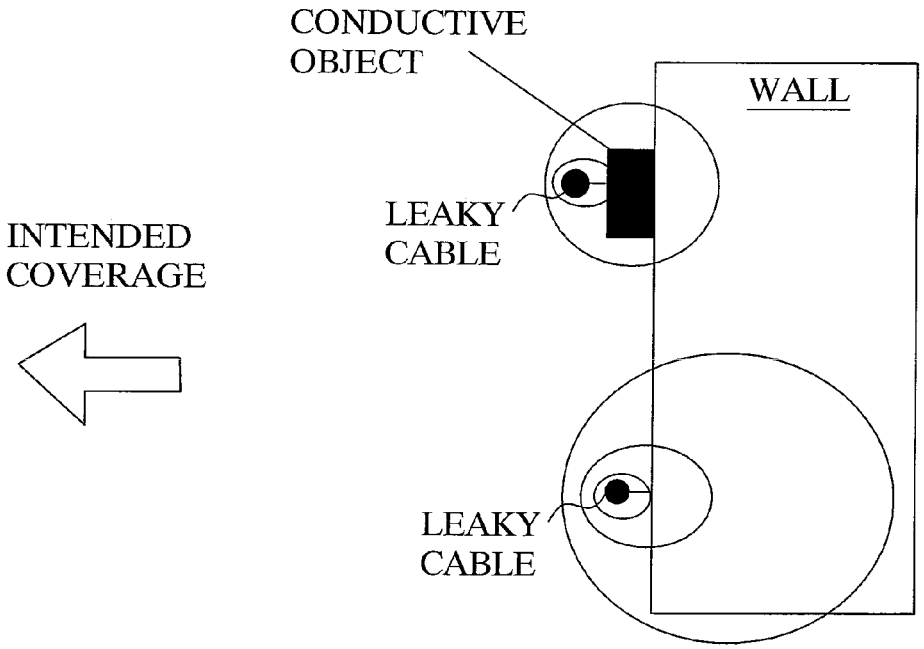
FIG. 4 is another example of a leaky cable installation.
Figure 5:
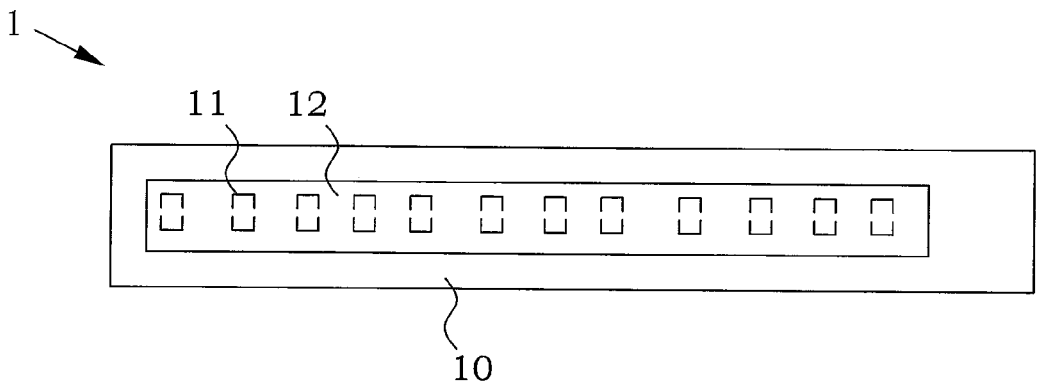
FIG. 5 is an embodiment of an arrangement according to the present disclosure.
Figure 6:
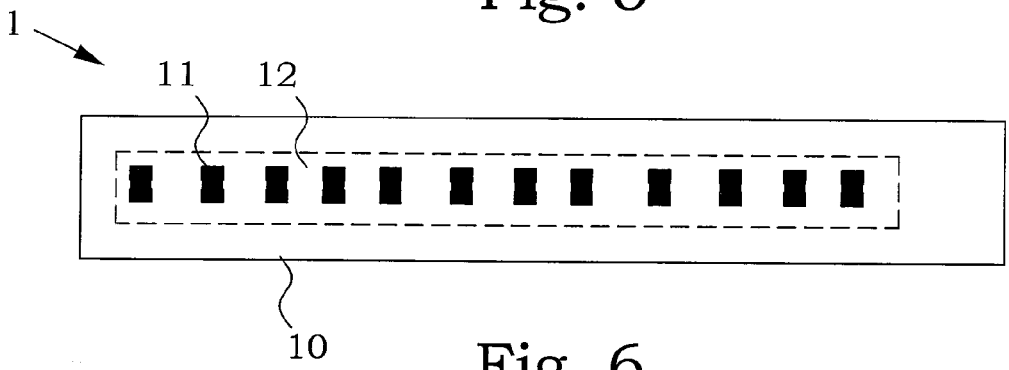
FIG. 6 is a further embodiment of an arrangement according to the present disclosure.

With reference to FIGS. 5 and 6, a basic embodiment of a leaky feeder or cable according to the present disclosure will be described. The leaky co-axial cable arrangement 1 includes a co-axial cable 10 with a plurality of radiation slots 11 arranged along its outer surface. The slots can be all inactive as shown in FIG. 5, but it is equally possible that the cable includes a mixture of both active and inactive radiating slots, or only active slots as shown in FIG. 6. In order to enable the cable to be adaptable or configurable, an activation arrangement 12 is provided on the co-axial cable 10. The activation arrangement 12 is configured for affecting predetermined regions on the cable 10 to selectively activate or deactivate at least one of the plurality of radiation slots 11 to provide the leaky co-axial cable arrangement 1. As mentioned in the background, the slots can be arranged uniformly and equidistant along the cable, or clustered into groups to provide different radiating properties when activated. Further, the activation arrangement 11 can comprise a single device arranged on the surface of the cable or a plurality of co-operating or individual arrangements.

According to a further embodiment, the activation arrangement 12 is reversible, i.e. it can be configured for affecting the predetermined regions on the cable 10 to either activate an inactive slot, or de-activate an already active or activated slot.

Figure 8:
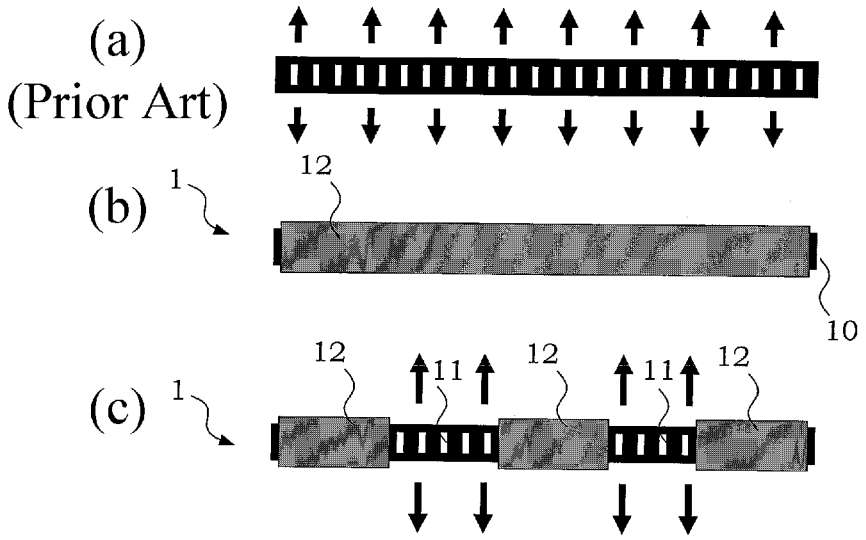
FIGS. 8(*a*), 8(*b*), and 8(*c*) depict further embodiments of an arrangement according to the present disclosure.
Figure 9:
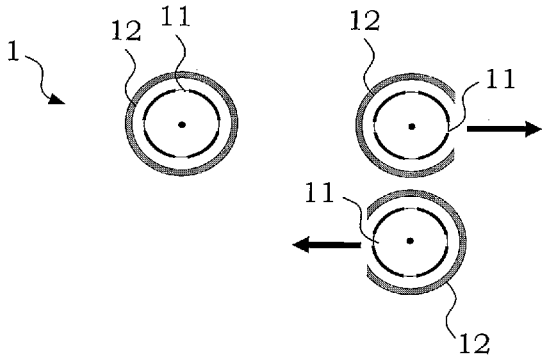
FIG. 9 is a further embodiment.

In FIG. 8(*a*) a prior art leaky cable is illustrated. The arrows indicate that the slots are active and radiating along the entire length of the cable. In FIG. 8(*b*), an embodiment of leaky feeder or cable arrangement 1 according to the present disclosure is shown. In this embodiment of the invention, a regular leaky cable 10 is covered by an activation arrangement 12 in the form of an additional outer conductor 12 that can be peeled off or removed pre or post installation. No part of the cable 10 is radiating. The leaky cable arrangement 1 includes a co-axial cable 10 with a plurality of inactive slots 11 (not shown) covered by an activation arrangement 12 in the form of an outer removable conductor. In FIG. 8(*c*), in the embodiment of the present disclosure, the activation arrangement 12 has been activated by having parts of the outer removable conductor 12 removed in two sections to uncover and activate the inactive slots 11 of the cable 10 in segments where it is desirable that the cable arrangement 1 radiates, preferably the sections are chosen to coincide with areas of intended coverage. In this embodiment, the outer conductor can consist of metallic tape or foil that can easily be removed in segments. The segments can be removed fully along certain sections of the cable as shown FIG. 8(*c*), or they can be partially removed to uncover radiating slots only on a specific side of the leaky cable as shown in FIG. 9. The outer conductor is according to a further embodiment preferably of a different color or texture such that it is apparent where it has been removed and where it is left in place.

This is further illustrated in FIG. 9, wherein the leaky cable 1 with an intact outer conductor 12 is disclosed on the left, and the leaky cable 1 with parts of the outer conductor 12 removed is disclosed on the right. The outer conductor 12 can be removed before installing the cable to uncover slots 11 on a particular side of the cable, or after installation when it is clear in what directions radiation is desirable.

Figure 10:
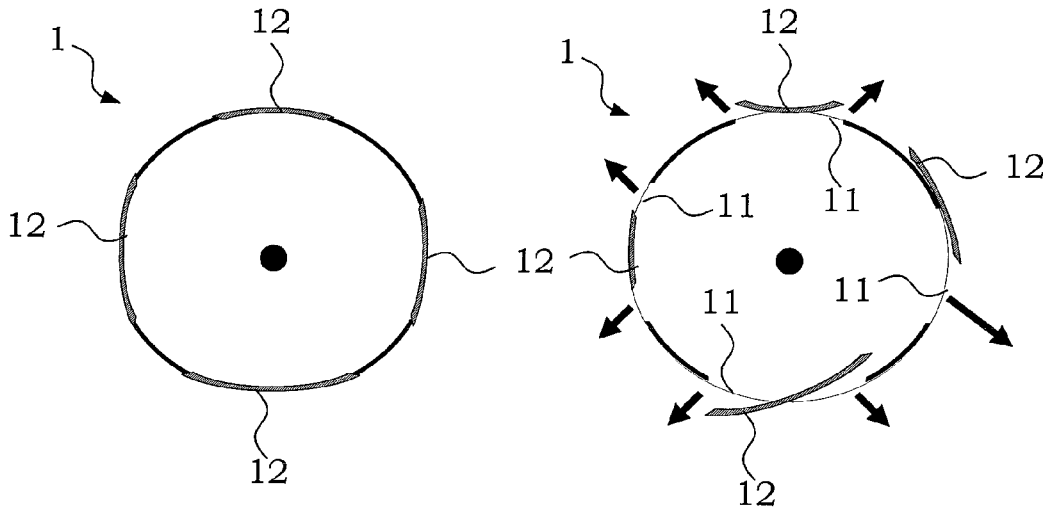
FIG. 10 is another embodiment.

According to a further embodiment, the activation arrangement 12 can comprise one or more outer conductors or conducting sheets 12 that are configured to change its shape, size, or orientation relative to the co-axial cable in order to activate or deactivate the radiating slots 11. For a cased of de-activation the same change in shape, size or orientation or position on the cable can be utilized to de-active an active slot. This is further illustrated in FIG. 10. A leaky cable 1 with inactive slots 11 covered by a plurality of conductive e.g. metallic sheets 12 is illustrated on the left. In this example, the sheets 12 are four in number, and oriented diametrically opposite each other. On the right, four examples of change of the conductive sheets 12 is illustrated. If the location of the sheets 12 is viewed as the face of a clock, then twelve o'clock illustrates how the shape of the conductive sheet is changed e.g. bent into a curve opposing the curve of the outer surface of the co-axial cable, whereby the slot 11 is activated. At three o'clock, the conductive sheet is displaced from the face of the slot 11 by sliding along the outer surface of the co-axial cable to reveal the slot underneath. At six o'clock, the conductive sheet is displaced by rotational motion to activate the slot 11. Finally, at nine o'clock the size of the conductive sheet is reduced, thus exposing the slot 11 underneath. The thus uncovering of the slots 11 by the above-described change of the conductive sheets can be provided by means of external or internal influence such as force, heat, or pressure. It is also possible to arrange the conductive sheets to respond to an externally applied electrical or magnetic field. In order to enable deactivating already active or activated slots 11, the sheets 12 can be configured to be reversibly shape changed.

According to a further embodiment, the conductive sheets 12 comprise metallic sheets or some other conducting or semi-conducting material.

Figure 11:
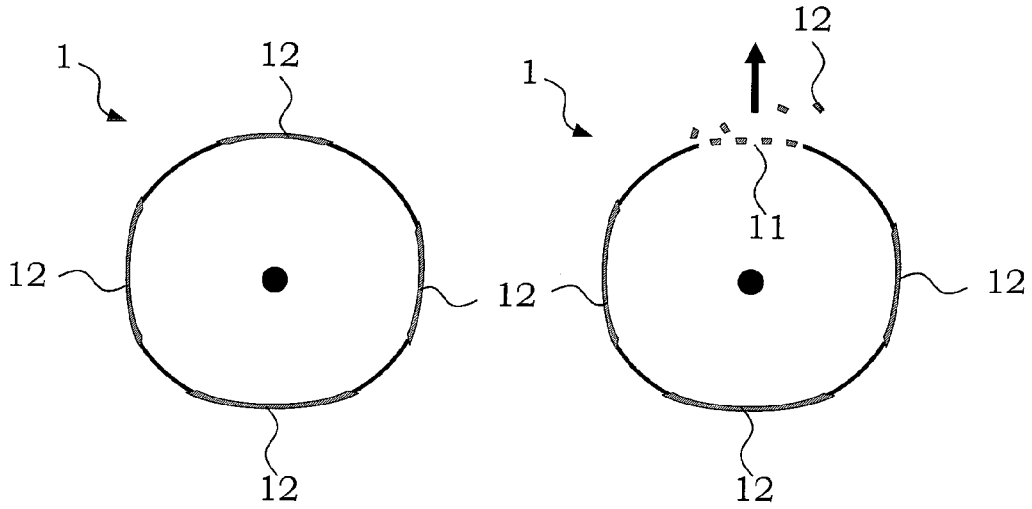
FIG. 11 is an additional embodiment.

The activation arrangement 12 can, according to a further embodiment and with reference to a cable arrangement 1 shown in FIG. 11, comprise an activation arrangement 12 in the form of a covering such as a conductive or metallic sheet configured to be breakable to activate the inactive slots 11. This is illustrated in FIG. 11, with a conductive sheet 12 broken into pieces at twelve o'clock. The breaking of the conductive sheet 12 can be enabled by means of an external influence such as heat, force, or pressure.

Figure 12:
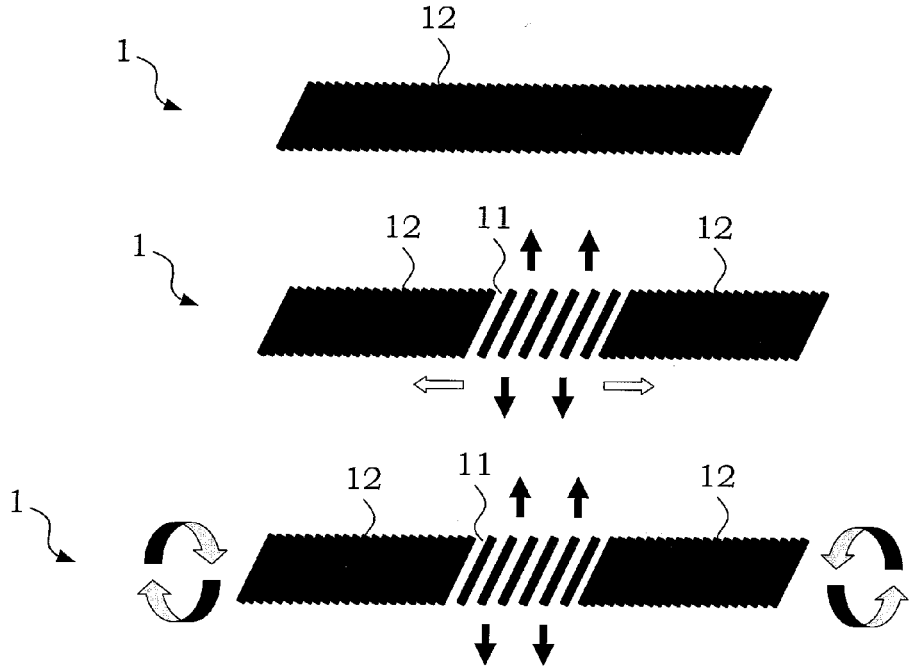
FIG. 12 is yet another embodiment.

According to a further embodiment of a cable arrangement 1, with reference to FIG. 12, the activation arrangement 12 can comprise a deformable outer casing such as a spring or coil-like outer conductor, which is configured for uncovering and activating the slots 11 through deformation of the outer casing. The topmost illustration in FIG. 12 discloses such a cable in an in-active state. The mid illustration discloses such a cable where the slots 11 are activated by means of stretching the cable e.g. activation arrangement 12. In the bottom illustration slots are activated by twisting the cable e.g. activation arrangement 12 to reveal the slots. This deformation can also be performed reversibly in order to deactivate active slots.

Figure 13:
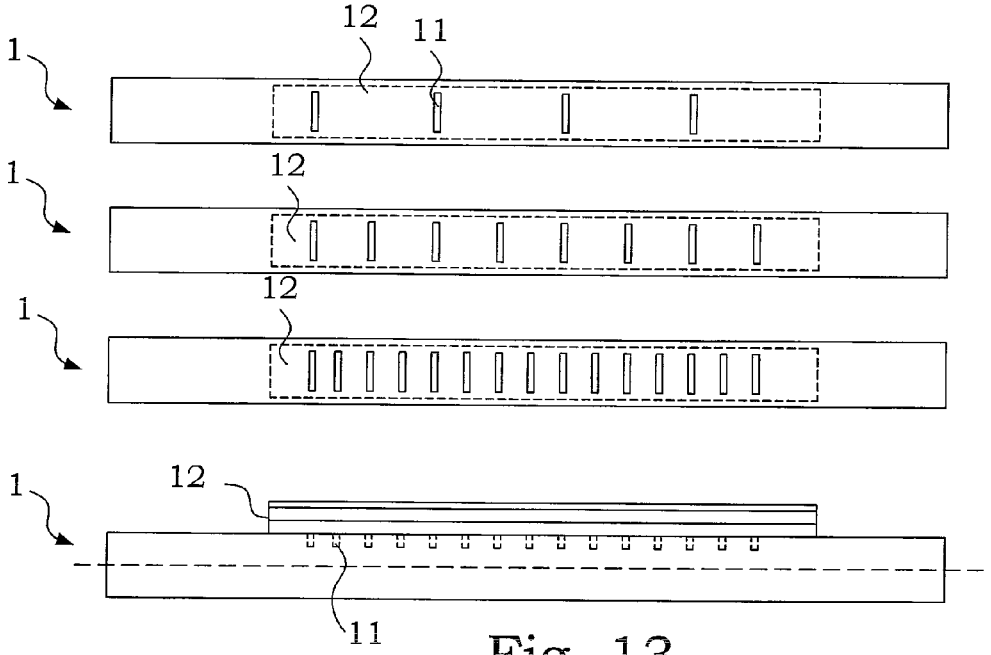
FIG. 13 is a further embodiment.

According to yet another embodiment, the activation arrangement 12 comprises a plurality of layered removable sheets of material. This is illustrated in a cable arrangement 1 having slots 11 as shown in FIG. 13, and in which an activation arrangement 12 in the form of three layered removable sheets are illustrated. Each of the sheets has a respective individual arrangement of slots overlapping at least some of the inactive slots, where the outmost layer in this example is without slots. By removing one or more of the layers, it is possible to adjust a radiation angle and power for different frequencies and spatial locations. It is likewise possible to reapply the layers. The slots of the individual layers are overlapping in order to enable providing a slot through one or more of the layered sheets. The view at the bottom of FIG. 13 illustrates a cross-section of a cable arrangement 1 with such an activation arrangement 12.

The activation arrangement 12 can, according to a further embodiment, be configured as an absorbing tape configured for adapting the impedance of the leaky cable arrangement 1. In one embodiment of the disclosure, the process of uncovering the slots in the leaky cable is reversible by design. In the case of the metallic tape or foil the slots can be covered again by the same tape or foil, for instance in order to improve characteristics further after e.g. a test measurement. Other circumstances that could motivate covering the slots are installation errors or reuse of the leaky cable in a new location. Another embodiment would be to use removable absorbing tape instead of metallic tape, or, a combination of metallic and absorbing tape. The radiating behavior of the cable and its impedance could then be changed into a more desirable mode.

Figure 7:
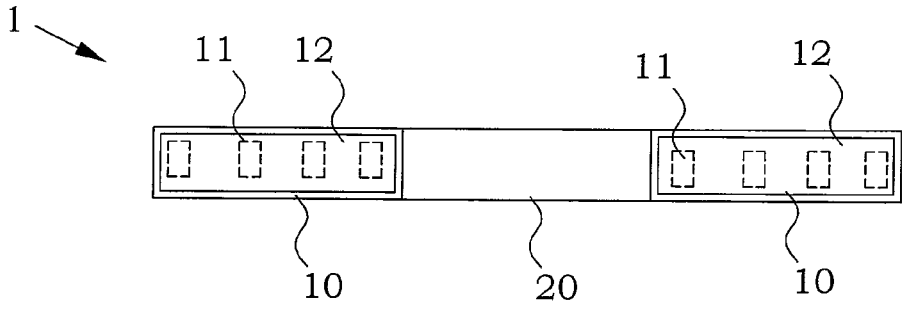
FIG. 7 is yet another embodiment of an arrangement according to the present disclosure.

A co-axial cable 10 in an arrangement 1 according to the present disclosure can beneficially be connected to another co-axial cable 20, leaky or non-leaky, which is illustrated in FIG. 7. This would enable using a standard co-axial cable for those areas where no radiation is desired, and utilize the adaptable arrangement according to the present disclosure in areas where radiation is wanted and needs to be configured accordingly.

Another embodiment is to use a combination of ordinary non-leaky coaxial cables and leaky cables covered with removable metallic tape. The two types of cables are manufactured in one or several fixed standard lengths, with connectors attached (thereby making the cables connectable), in order to make the installation simple and cost efficient. The non-leaky cables are installed along paths where radiating is never wanted.

Another embodiment is that the invention is applied on two or several cables that are put together (as two or several parallel lines) such that diversity or MIMO gains can be achieved. In this case, it is preferable to uncover slots on opposing sides or along different segments of the two cables in order to achieve good diversity, e.g. as outlined in FIG. 7.

Figure 14:
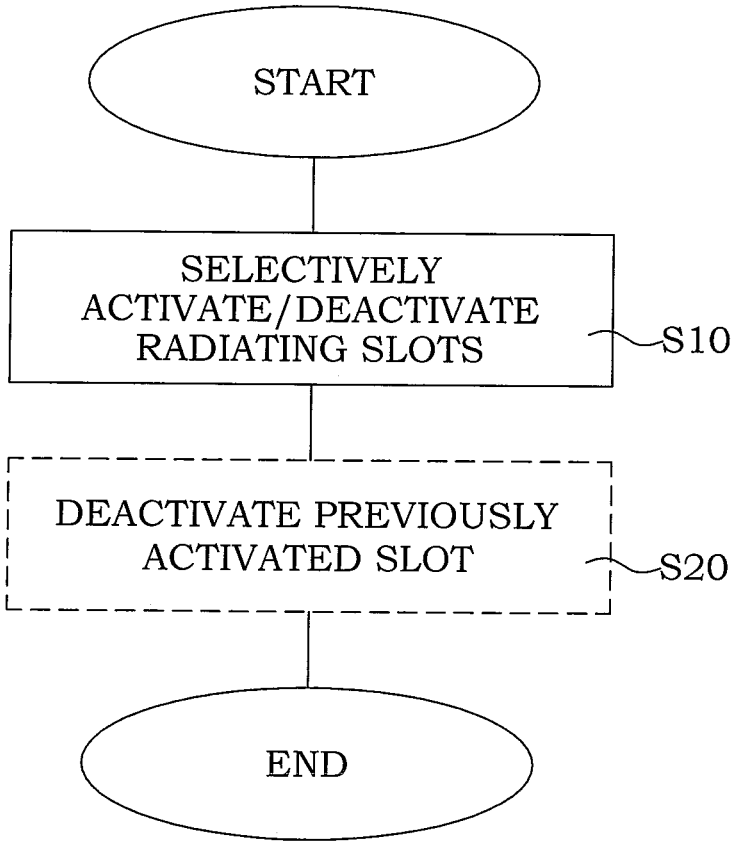
FIG. 14 is an embodiment of a method according to the present disclosure.

With reference to FIG. 14, an embodiment of a method for providing and installing the leaky cable described above will be described. FIG. 14 is a flow diagram, with "START" indicating the entry point of the illustrated method, and "END" representing the exit point of the illustrated method. As described with reference to the various embodiments of the cable arrangement, one or more radiating slots arranged on a co-axial cable are selectively activated or deactivated S10, preferably by utilizing an activation arrangement also arranged on the co-axial cable. The activation or deactivation can optionally be reversible, e.g. the activation arrangement can be utilized to de-activate S20 previously activated or already active slots. The activation/de-activation can be performed prior to installation of the cable at a premises, or after the cable is installed. Additionally, the activation/deactivation can be performed after a leaky cable has been removed from one location, in order to re-configure and adapt the cable for a new location.

Advantages of the present disclosure include making it easier to install the cable since the risk of having active slots facing in the wrong direction diminishes. Another advantage is that less power is lost through radiation in areas where no coverage is desired. The installation will be very cost efficient with fixed standard lengths of the cables and pre-mounted connectors.

Furthermore, cables of the design that is described here may be less sensitive to other objects in the vicinity of the cable and can therefore be installed with less stringent requirements on distance separations from walls, other cables etc. This may make installation simpler and also allow the use of leaky cables in locations where they have previously been considered as too bulky.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A leaky co-axial cable arrangement, comprising:

a co-axial cable;

a plurality of radiation slots arranged on said co-axial cable; and an activation arrangement configured for affecting predetermined regions on said coaxial cable to selectively activate or deactivate at least one of said plurality of radiation slots to provide said leaky co-axial cable arrangement, wherein said activation arrangement comprises a plurality of conductive sheets covering said radiation slots, and said plurality of conductive sheets are configured to change at least one of shape, size, or orientation in order to activate or deactivate said slots.

2. The arrangement according to claim 1, wherein said activation arrangement is reversible.

3. The arrangement according to claim 2, wherein said activation arrangement is further configured for affecting said predetermined regions on said cable to deactivate previously activated slots.

4. The arrangement according to claim 1, wherein said activation arrangement comprises an outer removable conductor covering one or more of the radiation slots.

5. The cable arrangement according to claim 1, wherein said co-axial cable is configured to be connectable to at least another co-axial cable.

6. The cable arrangement according to claim 1, wherein said plurality of radiating slots comprise both active and inactive radiating slots.

7. The cable arrangement according to claim 1, wherein said plurality of radiating slots comprise only active radiating slots.

8. A leaky co-axial cable arrangement, comprising:

a co-axial cable;

a plurality of radiation slots arranged on said co-axial cable; and an activation arrangement configured for affecting predetermined regions on said coaxial cable to selectively activate or deactivate at least one of said plurality of radiation slots to provide said leaky co-axial cable arrangement, wherein said activation arrangement comprises a plurality of layered removable sheets of material.

9. The arrangement according to claim 8, wherein each of said plurality of layered removable sheets of material are configured with a respective arrangement of slots overlapping at least some of said plurality of radiation slots.

10. A leaky co-axial cable arrangement, comprising:

a co-axial cable;

a plurality of radiation slots arranged on said co-axial cable; and an activation arrangement configured for affecting predetermined regions on said coaxial cable to selectively activate or deactivate at least one of said plurality of radiation slots to provide said leaky co-axial cable arrangement, wherein said activation arrangement comprises an absorbing tape covering one or more of the radiation slots of said leaky co-axial cable arrangement.

11. A leaky co-axial cable arrangement, comprising:

a co-axial cable;

a plurality of radiation slots arranged on said co-axial cable; and an activation arrangement configured for affecting predetermined regions on said coaxial cable to selectively activate or deactivate at least one of said plurality of radiation slots to provide said leaky co-axial cable arrangement, wherein said activation arrangement comprises a conductive sheet configured to be breakable to activate or deactivate said radiation slots.

12. A leaky co-axial cable arrangement, comprising:

a co-axial cable;

a plurality of radiation slots arranged on said co-axial cable; and an activation arrangement configured for affecting predetermined regions on said coaxial cable to selectively activate or deactivate at least one of said plurality of radiation slots to provide said leaky co-axial cable arrangement, wherein said activation arrangement comprises a deformable outer casing, which is configured for providing said plurality of radiation slots through deformation.

* * * * *